US011543218B2

(12) United States Patent
Overton et al.

(10) Patent No.: US 11,543,218 B2
(45) Date of Patent: Jan. 3, 2023

(54) POLYMER AMMUNITION HAVING AN ALIGNMENT AID, CARTRIDGE AND METHOD OF MAKING THE SAME

(71) Applicant: TRUE VELOCITY IP HOLDINGS, LLC, Garland, TX (US)

(72) Inventors: Christopher William Overton, Wylie, TX (US); Andrew Rosek, Rockwall, TX (US); Kenneth J. Overton, Princeton, TX (US); Florian Herzog, Dallas, TX (US)

(73) Assignee: True Velocity IP Holdings, LLC, Garland, TX (US)

( * ) Notice: Subject to any disclaimer, the term of this patent is extended or adjusted under 35 U.S.C. 154(b) by 0 days.

(21) Appl. No.: 16/930,583

(22) Filed: Jul. 16, 2020

(65) Prior Publication Data

US 2021/0108898 A1 Apr. 15, 2021

Related U.S. Application Data

(60) Provisional application No. 62/874,701, filed on Jul. 16, 2019.

(51) Int. Cl.
*F42B 5/307* (2006.01)

(52) U.S. Cl.
CPC ..... *F42B 5/307* (2013.01)

(58) Field of Classification Search
CPC ..... F42B 5/30; F42B 5/26; F42B 5/02; F42B 5/307; F42B 5/313; F42B 5/34; F42B 5/28

(Continued)

(56) References Cited

U.S. PATENT DOCUMENTS 99,528 A 2/1870 Boyd
113,634 A 4/1871 Crispin
(Continued)

FOREIGN PATENT DOCUMENTS

CA 2813634 A1 4/2012
CN 102901403 B 6/2014
(Continued)

OTHER PUBLICATIONS

DE 732216 C Internet translation (Year: 1943).*
(Continued)

*Primary Examiner* — Reginald S Tillman, Jr.
(74) *Attorney, Agent, or Firm* — Burdick Patents, P.A.; Sean Burdick

(57) ABSTRACT

One embodiment of the present invention provides a polymeric ammunition cartridge and methods of making and using the same. The cartridge includes a substantially cylindrical insert connected to a substantially cylindrical polymeric middle body. The substantially cylindrical insert includes a top surface opposite a bottom surface and a substantially cylindrical coupling element that extends from the bottom surface, a primer recess in the top surface that extends toward the bottom surface, a primer flash hole positioned in the primer recess to extend through the bottom surface, and a flange that extends circumferentially about an outer edge of the top surface. The substantially cylindrical polymeric middle body includes a substantially cylindrical polymeric bullet-end and a substantially cylindrical polymeric coupling end connected by a powder chamber, wherein the substantially cylindrical polymeric coupling end extends over the substantially cylindrical coupling element and covers a circumferential surface of the primer flash hole.

16 Claims, 6 Drawing Sheets

(58) Field of Classification Search
USPC ..... 102/430, 439, 464–466
See application file for complete search history.

(56) References Cited

U.S. PATENT DOCUMENTS 130,679 A 8/1872 Whitmore
159,665 A 2/1875 Gauthey
169,807 A 11/1875 Hart
207,248 A 8/1878 Bush et al.
462,611 A 11/1891 Comte de Sparre
475,008 A 5/1892 Bush
498,856 A 6/1893 Overbaugh
498,857 A 6/1893 Overbaugh
640,856 A 1/1900 Bailey
662,137 A 11/1900 Tellerson
676,000 A 6/1901 Henneberg
743,242 A 11/1903 Bush
865,979 A 9/1907 Bailey
869,046 A 10/1907 Bailey
905,358 A 12/1908 Peters
957,171 A 5/1910 Loeb
963,911 A 7/1910 Loeble
1,060,817 A 5/1913 Clyne
1,060,818 A 5/1913 Clyne
1,064,907 A 6/1913 Hoagland
1,187,464 A 6/1916 Offutt
1,842,445 A 1/1932 Clyne
1,936,905 A 11/1933 Gaidos
1,940,657 A * 12/1933 Woodford ..... F42B 5/26 102/465
2,048,267 A * 7/1936 Keith ..... F42B 5/26 102/465
2,294,822 A 9/1942 Norman
2,465,962 A 3/1949 Allen et al.
2,654,319 A 10/1953 Roske
2,823,611 A 2/1958 Thayer
2,862,446 A 12/1958 Lars
2,918,868 A 12/1959 Lars
2,936,709 A 5/1960 Seavey
2,953,990 A 9/1960 Miller
2,972,947 A 2/1961 Fitzsimmons et al.
3,034,433 A 5/1962 Karl
3,099,958 A 8/1963 Daubenspeck et al.
3,157,121 A 11/1964 Daubenspeck et al.
3,159,701 A 12/1964 Herter
3,170,401 A 2/1965 Johnson et al.
3,171,350 A 3/1965 Metcalf et al.
3,242,789 A 3/1966 Woodring
3,246,603 A 4/1966 Comerford
3,256,815 A 6/1966 Davidson et al.
3,288,066 A 11/1966 Hans et al.
3,292,538 A * 12/1966 Umbach ..... F42B 5/30 102/444
3,332,352 A 7/1967 Olson et al.
3,339,487 A * 9/1967 Umbach ..... F42B 8/04 102/444
3,410,213 A * 11/1968 Stadler ..... B25C 1/163 102/531
3,444,777 A 5/1969 Lage
3,446,146 A 5/1969 Stadler et al.
3,485,170 A 12/1969 Scanlon
3,485,173 A 12/1969 Morgan
3,491,691 A 1/1970 Vawter
3,565,008 A 2/1971 Gulley et al.
3,590,740 A 7/1971 Herter
3,609,904 A 10/1971 Scanlon
3,614,929 A 10/1971 Herter et al.
3,659,528 A 5/1972 Santala
3,688,699 A 9/1972 Horn et al.
3,690,256 A 9/1972 Schnitzer
3,745,924 A 7/1973 Scanlon
3,749,021 A 7/1973 Burgess
3,756,156 A 9/1973 Schuster
3,765,297 A 10/1973 Skochko et al.
3,768,413 A 10/1973 Ramsay
3,786,755 A 1/1974 Eckstein et al.
3,797,396 A 3/1974 Reed
3,842,739 A 10/1974 Scanlon et al.
3,866,536 A 2/1975 Greenberg
3,874,294 A 4/1975 Hale
3,955,506 A 5/1976 Luther et al.
3,977,326 A 8/1976 Anderson et al.
3,990,366 A 11/1976 Scanlon
4,005,630 A 2/1977 Patrick
4,020,763 A 5/1977 Iruretagoyena
4,132,173 A 1/1979 Amuchastegui
4,147,107 A 4/1979 Ringdal
4,157,684 A 6/1979 Clausser
4,173,186 A 11/1979 Dunham
4,179,992 A 12/1979 Ramnarace et al.
4,187,271 A 2/1980 Rolston et al.
4,228,724 A 10/1980 Leich
4,276,830 A 7/1981 Alice
4,353,304 A 10/1982 Hubsch et al.
4,475,435 A 10/1984 Mantel
4,483,251 A 11/1984 Spalding
4,598,445 A 7/1986 O'Connor
4,614,157 A 9/1986 Grelle et al.
4,679,505 A 7/1987 Reed
4,718,348 A 1/1988 Ferrigno
4,719,859 A 1/1988 Ballreich et al.
4,726,296 A 2/1988 Leshner et al.
4,763,576 A 8/1988 Kass et al.
4,867,065 A 9/1989 Kaltmann et al.
4,970,959 A 11/1990 Bilsbury et al.
5,021,206 A 6/1991 Stoops
5,033,386 A 7/1991 Vatsvog
5,063,853 A 11/1991 Bilgeri
5,090,327 A 2/1992 Bilgeri
5,151,555 A 9/1992 Vatsvog
5,165,040 A 11/1992 Andersson et al.
5,237,930 A 8/1993 Belanger et al.
5,247,888 A 9/1993 Conil
5,259,288 A 11/1993 Vatsvog
5,265,540 A 11/1993 Ducros et al.
D345,676 S 4/1994 Biffle
5,433,148 A 7/1995 Barratault et al.
5,535,495 A 7/1996 Gutowski
5,563,365 A 10/1996 Dineen et al.
5,616,642 A 4/1997 West et al.
D380,650 S 7/1997 Norris
5,679,920 A 10/1997 Hallis et al.
5,758,445 A 6/1998 Casull
5,770,815 A 6/1998 Watson
5,798,478 A 8/1998 Beal
5,950,063 A 9/1999 Hens et al.
5,961,200 A 10/1999 Friis
5,969,288 A 10/1999 Baud
5,979,331 A 11/1999 Casull
6,004,682 A 12/1999 Rackovan et al.
6,048,379 A 4/2000 Bray et al.
6,070,532 A 6/2000 Halverson
D435,626 S 12/2000 Benini
6,257,148 B1 7/2001 Toivonen et al.
6,257,149 B1 7/2001 Cesaroni
D447,209 S 8/2001 Benini
6,272,993 B1 8/2001 Cook et al.
6,283,035 B1 9/2001 Olson et al.
6,357,357 B1 3/2002 Glasser
D455,052 S 4/2002 Gullickson et al.
D455,320 S 4/2002 Edelstein
6,375,971 B1 4/2002 Hansen
6,408,764 B1 6/2002 Heitmann et al.
6,450,099 B1 9/2002 Desgland
6,460,464 B1 10/2002 Attarwala
6,523,476 B1 2/2003 Riess et al.
6,644,204 B2 11/2003 Pierrot et al.
6,649,095 B2 11/2003 Buja
6,672,219 B2 1/2004 Mackerell et al.
6,708,621 B1 3/2004 Forichon-Chaumet et al.
6,752,084 B1 6/2004 Husseini et al.
6,796,243 B2 9/2004 Schmees et al.
6,810,816 B2 11/2004 Rennard
6,840,149 B2 1/2005 Beal

(56) References Cited

U.S. PATENT DOCUMENTS 6,845,716 B2 1/2005 Husseini et al.
7,000,547 B2 2/2006 Amick
7,014,284 B2 3/2006 Morton et al.
7,032,492 B2 4/2006 Meshirer
7,056,091 B2 6/2006 Powers
7,059,234 B2 6/2006 Husseini
7,159,519 B2 1/2007 Robinson et al.
7,165,496 B2 1/2007 Reynolds
D540,710 S 4/2007 Charrin
7,204,191 B2 4/2007 Wiley et al.
7,213,519 B2 5/2007 Wiley et al.
7,231,519 B2 6/2007 Joseph et al.
7,232,473 B2 6/2007 Elliott
7,299,750 B2 11/2007 Schikora et al.
7,353,756 B2 4/2008 Leasure
7,380,505 B1 6/2008 Shiery
7,383,776 B2 6/2008 Amick
7,392,746 B2 7/2008 Hansen
7,426,888 B2 9/2008 Hunt
7,441,504 B2 10/2008 Husseini et al.
D583,927 S 12/2008 Benner
7,458,322 B2 12/2008 Reynolds et al.
7,461,597 B2 12/2008 Brunn
7,568,417 B1 8/2009 Lee
7,585,166 B2 9/2009 Buja
7,610,858 B2 11/2009 Chung
7,750,091 B2 7/2010 Maljkovic et al.
D626,619 S 11/2010 Gogol et al.
7,841,279 B2 11/2010 Reynolds et al.
D631,699 S 2/2011 Moreau
D633,166 S 2/2011 Richardson et al.
7,908,972 B2 3/2011 Brunn
7,930,977 B2 4/2011 Klein
8,007,370 B2 8/2011 Hirsch et al.
8,056,232 B2 11/2011 Patel et al.
8,156,870 B2 4/2012 South
8,186,273 B2 5/2012 Trivette
8,191,480 B2 6/2012 Mcaninch
8,201,867 B2 6/2012 Thomeczek
8,206,522 B2 6/2012 Sandstrom et al.
8,220,393 B2 7/2012 Schluckebier et al.
8,240,252 B2 8/2012 Maljkovic et al.
D675,882 S 2/2013 Crockett
8,393,273 B2 3/2013 Weeks et al.
8,408,137 B2 4/2013 Battaglia
D683,419 S 5/2013 Rebar
8,443,729 B2 5/2013 Mittelstaedt
8,443,730 B2 5/2013 Padgett
8,464,641 B2 6/2013 Se-Hong
8,511,233 B2 8/2013 Nilsson
D689,975 S 9/2013 Carlson et al.
8,522,684 B2 9/2013 Davies et al.
8,540,828 B2 9/2013 Busky et al.
8,561,543 B2 10/2013 Burrow
8,573,126 B2 11/2013 Klein et al.
8,641,842 B2 2/2014 Hafner et al.
8,689,696 B1 4/2014 Seeman et al.
8,763,535 B2 7/2014 Padgett
8,790,455 B2 7/2014 Borissov et al.
8,807,008 B2 8/2014 Padgett et al.
8,807,040 B2 8/2014 Menefee, III
8,813,650 B2 8/2014 Maljkovic et al.
D715,888 S 10/2014 Padgett
8,850,985 B2 10/2014 Maljkovic et al.
8,857,343 B2 10/2014 Marx
8,869,702 B2 10/2014 Padgett
D717,909 S 11/2014 Thrift et al.
8,875,633 B2 11/2014 Padgett
8,893,621 B1 11/2014 Escobar
8,915,191 B2 12/2014 Jones
8,978,559 B2 3/2015 Davies et al.
8,985,023 B2 3/2015 Mason
9,003,973 B1 4/2015 Padgett
9,032,855 B1 5/2015 Foren et al.
9,091,516 B2 7/2015 Davies et al.
9,103,641 B2 8/2015 Nielson et al.
9,111,177 B2 8/2015 Tateno et al.
9,157,709 B2 10/2015 Nuetzman et al.
9,170,080 B2 10/2015 Poore et al.
9,182,204 B2 11/2015 Maljkovic et al.
9,188,412 B2 11/2015 Maljkovic et al.
9,200,157 B2 12/2015 El-Hibri et al.
9,200,878 B2 12/2015 Seecamp
9,200,880 B1 12/2015 Foren et al.
9,212,876 B1 12/2015 Kostka et al.
9,212,879 B2 12/2015 Whitworth
9,213,175 B2 12/2015 Arnold
9,254,503 B2 2/2016 Ward
9,255,775 B1 2/2016 Rubin
D752,397 S 3/2016 Seiders et al.
9,273,941 B2 3/2016 Carlson et al.
D754,223 S 4/2016 Pederson et al.
9,329,004 B2 5/2016 Pace
9,335,137 B2 5/2016 Maljkovic et al.
9,337,278 B1 5/2016 Gu et al.
9,347,457 B2 5/2016 Ahrens et al.
9,366,512 B2 6/2016 Burczynski et al.
9,372,054 B2 6/2016 Padgett
9,377,278 B2 6/2016 Rubin
9,389,052 B2 7/2016 Conroy et al.
9,395,165 B2 7/2016 Maljkovic et al.
D764,624 S 8/2016 Masinelli
D765,214 S 8/2016 Padgett
9,429,407 B2 8/2016 Burrow
9,441,930 B2 9/2016 Burrow
9,453,714 B2 9/2016 Bosarge et al.
D773,009 S 11/2016 Bowers
9,500,453 B2 11/2016 Schluckebier et al.
9,506,735 B1 11/2016 Burrow
D774,824 S 12/2016 Gallagher
9,513,092 B2 12/2016 Emary
9,513,096 B2 12/2016 Burrow
9,518,810 B1 12/2016 Burrow
9,523,563 B1 12/2016 Burrow
9,528,799 B2 12/2016 Maljkovic
9,546,849 B2 1/2017 Burrow
9,551,557 B1 1/2017 Burrow
D778,391 S 2/2017 Burrow
D778,393 S 2/2017 Burrow
D778,394 S 2/2017 Burrow
D778,395 S 2/2017 Burrow
D779,021 S 2/2017 Burrow
D779,024 S 2/2017 Burrow
D780,283 S 2/2017 Burrow
9,587,918 B1 3/2017 Burrow
9,599,443 B2 3/2017 Padgett et al.
9,625,241 B2 4/2017 Neugebauer
9,631,907 B2 4/2017 Burrow
9,644,930 B1 5/2017 Burrow
9,658,042 B2 5/2017 Emary
9,683,818 B2 6/2017 Lemke et al.
D792,200 S 7/2017 Baiz et al.
9,709,368 B2 7/2017 Mahnke
D797,880 S 9/2017 Seecamp
9,759,554 B2 9/2017 Ng et al.
D800,244 S 10/2017 Burczynski et al.
D800,245 S 10/2017 Burczynski et al.
D800,246 S 10/2017 Burczynski et al.
9,784,667 B2 10/2017 Lukay et al.
9,835,423 B2 12/2017 Burrow
9,835,427 B2 12/2017 Burrow
9,857,151 B2 1/2018 Dionne et al.
9,869,536 B2 1/2018 Burrow
9,879,954 B2 1/2018 Hajjar
9,885,551 B2 2/2018 Burrow
D813,975 S 3/2018 White
9,921,040 B2 3/2018 Rubin
9,927,219 B2 3/2018 Burrow
9,933,241 B2 4/2018 Burrow
9,939,236 B2 4/2018 Drobockyi et al.
9,964,388 B1 5/2018 Burrow
D821,536 S 6/2018 Christiansen et al.
9,989,339 B2 6/2018 Riess
9,989,343 B2 6/2018 Padgett et al.

(56) References Cited

U.S. PATENT DOCUMENTS

| | | | |
|---|---|---|---|
| 10,041,770 | B2 | 8/2018 | Burrow |
| 10,041,771 | B1 | 8/2018 | Burrow |
| 10,041,776 | B1 | 8/2018 | Burrow |
| 10,041,777 | B1 | 8/2018 | Burrow |
| 10,048,049 | B2 | 8/2018 | Burrow |
| 10,048,050 | B1 | 8/2018 | Burrow |
| 10,048,052 | B2 | 8/2018 | Burrow |
| 10,054,413 | B1 | 8/2018 | Burrow |
| D828,483 | S | 9/2018 | Burrow |
| 10,081,057 | B2 | 9/2018 | Burrow |
| D832,037 | S | 10/2018 | Gallagher |
| 10,101,140 | B2 | 10/2018 | Burrow |
| 10,124,343 | B2 | 11/2018 | Tsai |
| 10,145,662 | B2 | 12/2018 | Burrow |
| 10,190,857 | B2 | 1/2019 | Burrow |
| 10,234,249 | B2 | 3/2019 | Burrow |
| 10,234,253 | B2 | 3/2019 | Burrow |
| 10,240,905 | B2 | 3/2019 | Burrow |
| 10,254,096 | B2 | 4/2019 | Burrow |
| 10,260,847 | B2 | 4/2019 | Viggiano et al. |
| D849,181 | S | 5/2019 | Burrow |
| 10,302,403 | B2 | 5/2019 | Burrow |
| 10,302,404 | B2 | 5/2019 | Burrow |
| 10,323,918 | B2 | 6/2019 | Menefee, III |
| 10,330,451 | B2 | 6/2019 | Burrow |
| 10,345,088 | B2 | 7/2019 | Burrow |
| 10,352,664 | B2 | 7/2019 | Burrow |
| 10,352,670 | B2 | 7/2019 | Burrow |
| 10,359,262 | B2 | 7/2019 | Burrow |
| 10,365,074 | B2 | 7/2019 | Burrow |
| D861,118 | S | 9/2019 | Burrow |
| D861,119 | S | 9/2019 | Burrow |
| 10,408,582 | B2 | 9/2019 | Burrow |
| 10,408,592 | B2 | 9/2019 | Boss et al. |
| 10,415,943 | B2 | 9/2019 | Burrow |
| 10,429,156 | B2 | 10/2019 | Burrow |
| 10,458,762 | B2 | 10/2019 | Burrow |
| 10,466,020 | B2 | 11/2019 | Burrow |
| 10,466,021 | B2 | 11/2019 | Burrow |
| 10,480,911 | B2 | 11/2019 | Burrow |
| 10,480,912 | B2 | 11/2019 | Burrow |
| 10,480,915 | B2 | 11/2019 | Burrow et al. |
| 10,488,165 | B2 | 11/2019 | Burrow |
| 10,533,830 | B2 | 1/2020 | Burrow et al. |
| 10,571,162 | B2 | 2/2020 | Makansi et al. |
| 10,571,228 | B2 | 2/2020 | Burrow |
| 10,571,229 | B2 | 2/2020 | Burrow |
| 10,571,230 | B2 | 2/2020 | Burrow |
| 10,571,231 | B2 | 2/2020 | Burrow |
| 10,578,409 | B2 | 3/2020 | Burrow |
| 10,591,260 | B2 | 3/2020 | Burrow et al. |
| D882,019 | S | 4/2020 | Burrow et al. |
| D882,020 | S | 4/2020 | Burrow et al. |
| D882,021 | S | 4/2020 | Burrow et al. |
| D882,022 | S | 4/2020 | Burrow et al. |
| D882,023 | S | 4/2020 | Burrow et al. |
| D882,024 | S | 4/2020 | Burrow et al. |
| D882,025 | S | 4/2020 | Burrow et al. |
| D882,026 | S | 4/2020 | Burrow et al. |
| D882,027 | S | 4/2020 | Burrow et al. |
| D882,028 | S | 4/2020 | Burrow et al. |
| D882,029 | S | 4/2020 | Burrow et al. |
| D882,030 | S | 4/2020 | Burrow et al. |
| D882,031 | S | 4/2020 | Burrow et al. |
| D882,032 | S | 4/2020 | Burrow et al. |
| D882,033 | S | 4/2020 | Burrow et al. |
| D882,720 | S | 4/2020 | Burrow et al. |
| D882,721 | S | 4/2020 | Burrow et al. |
| D882,722 | S | 4/2020 | Burrow et al. |
| D882,723 | S | 4/2020 | Burrow et al. |
| D882,724 | S | 4/2020 | Burrow et al. |
| 10,612,896 | B2 | 4/2020 | Burrow |
| 10,612,897 | B2 | 4/2020 | Burrow et al. |
| D884,115 | S | 5/2020 | Burrow et al. |
| 10,663,271 | B2 | 5/2020 | Rogers |
| D886,231 | S | 6/2020 | Burrow et al. |
| D886,937 | S | 6/2020 | Burrow et al. |
| 10,677,573 | B2 | 6/2020 | Burrow et al. |
| D891,567 | S | 7/2020 | Burrow et al. |
| D891,568 | S | 7/2020 | Burrow et al. |
| D891,569 | S | 7/2020 | Burrow et al. |
| D891,570 | S | 7/2020 | Burrow et al. |
| 10,704,869 | B2 | 7/2020 | Burrow et al. |
| 10,704,870 | B2 | 7/2020 | Burrow et al. |
| 10,704,871 | B2 | 7/2020 | Burrow et al. |
| 10,704,872 | B1 | 7/2020 | Burrow et al. |
| 10,704,876 | B2 | 7/2020 | Boss et al. |
| 10,704,877 | B2 | 7/2020 | Boss et al. |
| 10,704,878 | B2 | 7/2020 | Boss et al. |
| 10,704,879 | B1 | 7/2020 | Burrow et al. |
| 10,704,880 | B1 | 7/2020 | Burrow et al. |
| D892,258 | S | 8/2020 | Burrow et al. |
| D893,665 | S | 8/2020 | Burrow et al. |
| D893,666 | S | 8/2020 | Burrow et al. |
| D893,667 | S | 8/2020 | Burrow et al. |
| D893,668 | S | 8/2020 | Burrow et al. |
| D894,320 | S | 8/2020 | Burrow et al. |
| 10,731,956 | B2 | 8/2020 | Burrow et al. |
| 10,731,957 | B1 | 8/2020 | Burrow et al. |
| 10,753,713 | B2 | 8/2020 | Burrow |
| 10,760,882 | B1 | 9/2020 | Burrow |
| 10,782,107 | B1 | 9/2020 | Dindl |
| 10,794,671 | B2 | 10/2020 | Padgett et al. |
| 10,809,043 | B2 | 10/2020 | Padgett et al. |
| D903,038 | S | 11/2020 | Burrow et al. |
| D903,039 | S | 11/2020 | Burrow et al. |
| 10,845,169 | B2 | 11/2020 | Burrow |
| 10,852,108 | B2 | 12/2020 | Burrow et al. |
| 10,859,352 | B2 | 12/2020 | Burrow |
| 10,871,361 | B2 | 12/2020 | Skowron et al. |
| 10,876,822 | B2 | 12/2020 | Burrow et al. |
| 10,900,760 | B2 | 1/2021 | Burrow |
| 10,907,944 | B2 | 2/2021 | Burrow |
| 10,914,558 | B2 | 2/2021 | Burrow |
| 10,921,100 | B2 | 2/2021 | Burrow et al. |
| 10,921,101 | B2 | 2/2021 | Burrow et al. |
| 10,921,106 | B2 | 2/2021 | Burrow et al. |
| D913,403 | S | 3/2021 | Burrow et al. |
| 10,948,272 | B1 | 3/2021 | Drobockyi et al. |
| 10,948,273 | B2 | 3/2021 | Burrow et al. |
| 10,948,275 | B2 | 3/2021 | Burrow |
| 10,962,338 | B2 | 3/2021 | Burrow |
| 10,976,144 | B1 | 4/2021 | Peterson et al. |
| 10,996,029 | B2 | 5/2021 | Burrow |
| 10,996,030 | B2 | 5/2021 | Burrow |
| 11,047,654 | B1 | 6/2021 | Burrow |
| 11,047,655 | B2 | 6/2021 | Burrow et al. |
| 11,047,661 | B2 | 6/2021 | Burrow |
| 11,047,662 | B2 | 6/2021 | Burrow |
| 11,047,663 | B1 | 6/2021 | Burrow |
| 11,047,664 | B2 | 6/2021 | Burrow |
| 11,079,205 | B2 | 8/2021 | Burrow et al. |
| 11,079,209 | B2 | 8/2021 | Burrow |
| 11,085,739 | B2 | 8/2021 | Burrow |
| 11,085,740 | B2 | 8/2021 | Burrow |
| 11,085,741 | B2 | 8/2021 | Burrow |
| 11,085,742 | B2 | 8/2021 | Burrow |
| 11,092,413 | B2 | 8/2021 | Burrow |
| 11,098,990 | B2 | 8/2021 | Burrow |
| 11,098,991 | B2 | 8/2021 | Burrow |
| 11,098,992 | B2 | 8/2021 | Burrow |
| 11,098,993 | B2 | 8/2021 | Burrow |
| 11,112,224 | B2 | 9/2021 | Burrow et al. |
| 11,112,225 | B2 | 9/2021 | Burrow et al. |
| 11,118,875 | B1 | 9/2021 | Burrow |
| 11,118,876 | B2 | 9/2021 | Burrow et al. |
| 11,118,877 | B2 | 9/2021 | Burrow et al. |
| 11,118,882 | B2 | 9/2021 | Burrow |
| 11,125,540 | B2 | 9/2021 | Pennell et al. |
| 11,209,251 | B2 | 12/2021 | Burrow et al. |
| 11,209,252 | B2 | 12/2021 | Burow |
| 11,209,256 | B2 | 12/2021 | Burrow et al. |
| 11,215,430 | B2 | 1/2022 | Boss et al. |
| 11,226,179 | B2 | 1/2022 | Burrow |

(56) References Cited

U.S. PATENT DOCUMENTS 11,231,257 B2 1/2022 Burrow
11,231,258 B2 1/2022 Burrow
11,243,059 B2 2/2022 Burrow
11,243,060 B2 2/2022 Burrow
2007/0056343 A1 3/2007 Cremonesi
2007/0214992 A1 9/2007 Dittrich
2007/0214993 A1 9/2007 Cerovic et al.
2007/0267587 A1 11/2007 Dalluge
2011/0179965 A1 7/2011 Mason
2012/0060716 A1 3/2012 Davies et al.
2012/0111219 A1* 5/2012 Burrow ..... F42C 19/083 102/467
2012/0180687 A1 7/2012 Padgett et al.
2014/0075805 A1 3/2014 LaRue
2014/0260925 A1 9/2014 Beach et al.
2015/0226220 A1 8/2015 Bevington
2016/0003590 A1 1/2016 Burrow
2016/0003593 A1 1/2016 Burrow
2016/0003594 A1 1/2016 Burrow
2016/0003597 A1 1/2016 Burrow
2016/0003601 A1 1/2016 Burrow
2016/0102030 A1 4/2016 Coffey et al.
2016/0245626 A1 8/2016 Drieling et al.
2016/0265886 A1 9/2016 Aldrich et al.
2016/0356588 A1 12/2016 Burrow
2017/0082409 A1 3/2017 Burrow
2017/0082411 A1 3/2017 Burrow
2017/0089675 A1 3/2017 Burrow
2017/0115105 A1 4/2017 Burrow
2017/0153099 A9 6/2017 Burrow
2017/0205217 A9 7/2017 Burrow
2017/0328689 A1 11/2017 Dindl
2018/0066925 A1 3/2018 Skowron et al.
2018/0224252 A1 8/2018 O'Rourke
2018/0292186 A1 10/2018 Padgett et al.
2018/0306558 A1 10/2018 Padgett et al.
2019/0011233 A1 1/2019 Boss et al.
2019/0011234 A1 1/2019 Boss et al.
2019/0011235 A1 1/2019 Boss et al.
2019/0011241 A1 1/2019 Burrow
2019/0025019 A1 1/2019 Burrow
2019/0025020 A1 1/2019 Burrow
2019/0025021 A1 1/2019 Burrow
2019/0025022 A1 1/2019 Burrow
2019/0025023 A1 1/2019 Burrow
2019/0025024 A1 1/2019 Burrow
2019/0025025 A1 1/2019 Burrow
2019/0025026 A1 1/2019 Burrow
2019/0078862 A1 3/2019 Burrow
2019/0106364 A1 4/2019 James
2019/0107375 A1 4/2019 Burrow
2019/0137228 A1 5/2019 Burrow et al.
2019/0137229 A1 5/2019 Burrow et al.
2019/0137230 A1 5/2019 Burrow et al.
2019/0137233 A1 5/2019 Burrow et al.
2019/0137234 A1 5/2019 Burrow et al.
2019/0137235 A1 5/2019 Burrow et al.
2019/0137236 A1 5/2019 Burrow et al.
2019/0137238 A1 5/2019 Burrow et al.
2019/0137239 A1 5/2019 Burrow et al.
2019/0137240 A1 5/2019 Burrow et al.
2019/0137241 A1 5/2019 Burrow et al.
2019/0137243 A1 5/2019 Burrow et al.
2019/0137244 A1 5/2019 Burrow et al.
2019/0170488 A1 6/2019 Burrow
2019/0204050 A1 7/2019 Burrow
2019/0204056 A1 7/2019 Burrow
2019/0212117 A1 7/2019 Burrow
2019/0242679 A1 8/2019 Viggiano et al.
2019/0242682 A1 8/2019 Burrow
2019/0242683 A1 8/2019 Burrow
2019/0249967 A1 8/2019 Burrow et al.
2019/0257625 A1 8/2019 Burrow
2019/0285391 A1 9/2019 Menefee, III
2019/0310058 A1 10/2019 Burrow
2019/0310059 A1 10/2019 Burrow
2019/0316886 A1 10/2019 Burrow
2019/0360788 A1 11/2019 Burrow
2019/0376773 A1 12/2019 Burrow
2019/0376774 A1 12/2019 Boss et al.
2019/0383590 A1 12/2019 Burrow
2019/0390929 A1 12/2019 Libotte
2020/0011645 A1 1/2020 Burrow et al.
2020/0011646 A1 1/2020 Burrow et al.
2020/0025536 A1 1/2020 Burrow et al.
2020/0025537 A1 1/2020 Burrow et al.
2020/0033102 A1 1/2020 Burrow
2020/0033103 A1 1/2020 Burrow et al.
2020/0041239 A1 2/2020 Burrow
2020/0049469 A1 2/2020 Burrow
2020/0049470 A1 2/2020 Burrow
2020/0049471 A1 2/2020 Burrow
2020/0049472 A1 2/2020 Burrow
2020/0049473 A1 2/2020 Burrow
2020/0056872 A1 2/2020 Burrow
2020/0109932 A1 4/2020 Burrow
2020/0149853 A1 5/2020 Burrow
2020/0158483 A1 5/2020 Burrow
2020/0200512 A1 6/2020 Burrow
2020/0200513 A1 6/2020 Burrow
2020/0208948 A1 7/2020 Burrow
2020/0208949 A1 7/2020 Burrow
2020/0208950 A1 7/2020 Burrow
2020/0225009 A1 7/2020 Burrow
2020/0248998 A1 8/2020 Burrow
2020/0248999 A1 8/2020 Burrow
2020/0249000 A1 8/2020 Burrow
2020/0256654 A1 8/2020 Burrow
2020/0263962 A1 8/2020 Burrow et al.
2020/0263967 A1 8/2020 Burrow et al.
2020/0278183 A1 9/2020 Burrow et al.
2020/0292283 A1 9/2020 Burrow
2020/0300587 A1 9/2020 Burrow et al.
2020/0300592 A1 9/2020 Overton et al.
2020/0309490 A1 10/2020 Burrow et al.
2020/0309496 A1 10/2020 Burrow et al.
2020/0318937 A1 10/2020 Skowron et al.
2020/0326168 A1 10/2020 Boss et al.
2020/0363172 A1 11/2020 Koh et al.
2020/0363173 A1 11/2020 Burrow
2020/0363179 A1 11/2020 Overton et al.
2020/0378734 A1 12/2020 Burrow
2020/0393220 A1 12/2020 Burrow
2020/0400411 A9 12/2020 Burrow
2021/0003373 A1 1/2021 Burrow
2021/0041211 A1 2/2021 Pennell et al.
2021/0041212 A1 2/2021 Burrow et al.
2021/0041213 A1 2/2021 Padgett
2021/0072006 A1 3/2021 Padgett et al.
2021/0080236 A1 3/2021 Burrow
2021/0080237 A1 3/2021 Burrow et al.
2021/0108899 A1 4/2021 Burrow et al.
2021/0123709 A1 4/2021 Burrow et al.
2021/0131772 A1 5/2021 Burrow
2021/0131773 A1 5/2021 Burrow
2021/0131774 A1 5/2021 Burrow
2021/0140749 A1 5/2021 Burrow
2021/0148681 A1 5/2021 Burrow
2021/0148682 A1 5/2021 Burrow
2021/0148683 A1 5/2021 Burrow et al.
2021/0156653 A1 5/2021 Burrow et al.
2021/0164762 A1 6/2021 Burrow et al.
2021/0223017 A1 7/2021 Peterson et al.
2021/0254939 A1 8/2021 Burrow
2021/0254940 A1 8/2021 Burrow
2021/0254941 A1 8/2021 Burrow
2021/0254942 A1 8/2021 Burrow
2021/0254943 A1 8/2021 Burrow
2021/0254944 A1 8/2021 Burrow
2021/0254945 A1 8/2021 Burrow
2021/0254946 A1 8/2021 Burrow
2021/0254947 A1 8/2021 Burrow
2021/0254948 A1 8/2021 Burrow
2021/0254949 A1 8/2021 Burrow

(56) References Cited

U.S. PATENT DOCUMENTS

| | | | |
|---|---|---|---|
| 2021/0270579 | A1 | 9/2021 | Burrow |
| 2021/0270580 | A1 | 9/2021 | Burrow |
| 2021/0270581 | A1 | 9/2021 | Burrow |
| 2021/0270582 | A1 | 9/2021 | Burrow |
| 2021/0270588 | A1 | 9/2021 | Burrow et al. |
| 2021/0278179 | A1 | 9/2021 | Burrow et al. |
| 2021/0302136 | A1 | 9/2021 | Burrow |
| 2021/0302137 | A1 | 9/2021 | Burrow |
| 2021/0325156 | A1 | 10/2021 | Burrow |
| 2021/0325157 | A1 | 10/2021 | Burrow |
| 2021/0333073 | A1 | 10/2021 | Burrow et al. |
| 2021/0333075 | A1 | 10/2021 | Burrow |
| 2021/0341266 | A1 | 11/2021 | Burrow |
| 2021/0341267 | A1 | 11/2021 | Burrow |
| 2021/0341268 | A1 | 11/2021 | Burrow |
| 2021/0341269 | A1 | 11/2021 | Burrow |
| 2021/0341270 | A1 | 11/2021 | Burrow |
| 2021/0341271 | A1 | 11/2021 | Burrow |
| 2021/0341272 | A1 | 11/2021 | Burrow |
| 2021/0341273 | A1 | 11/2021 | Burrow |
| 2021/0348892 | A1 | 11/2021 | Burrow |
| 2021/0348893 | A1 | 11/2021 | Burrow |
| 2021/0348894 | A1 | 11/2021 | Burrow |
| 2021/0348895 | A1 | 11/2021 | Burrow |
| 2021/0348902 | A1 | 11/2021 | Burrow |
| 2021/0348903 | A1 | 11/2021 | Burrow |
| 2021/0348904 | A1 | 11/2021 | Burrow |
| 2021/0364257 | A1 | 11/2021 | Burrow et al. |
| 2021/0364258 | A1 | 11/2021 | Burrow et al. |
| 2021/0372747 | A1 | 12/2021 | Burrow |
| 2021/0372748 | A1 | 12/2021 | Burrow et al. |
| 2021/0372749 | A1 | 12/2021 | Burrow et al. |
| 2021/0372750 | A1 | 12/2021 | Burrow et al. |
| 2021/0372751 | A1 | 12/2021 | Burrow et al. |
| 2021/0372754 | A1 | 12/2021 | Burrow |
| 2021/0381813 | A1 | 12/2021 | Burrow |
| 2021/0389106 | A1 | 12/2021 | Burrow |
| 2022/0011083 | A1 | 1/2022 | Burrow |
| 2022/0018639 | A1 | 1/2022 | Burrow |
| 2022/0018640 | A1 | 1/2022 | Burrow et al. |
| 2022/0018641 | A1 | 1/2022 | Burrow |
| 2022/0034639 | A1 | 2/2022 | Burrow |

FOREIGN PATENT DOCUMENTS

| | | | | | |
|---|---|---|---|---|---|
| DE | 16742 | C | | 1/1882 | |
| DE | 732216 | C | * | 2/1943 | ..... F42B 5/28 |
| DE | 732216 | C | * | 2/1943 | ..... F42B 5/28 |
| EP | 2625486 | A4 | | 8/2017 | |
| FR | 1412414 | A | | 10/1965 | |
| GB | 574877 | A | | 1/1946 | |
| GB | 783023 | A | | 9/1957 | |
| GB | 1028951 | A | * | 5/1966 | ..... F42B 8/02 |
| RU | 2172467 | C1 | | 8/2001 | |
| WO | 0034732 | | | 6/2000 | |
| WO | 2007014024 | A2 | | 2/2007 | |
| WO | 2012047615 | A1 | | 4/2012 | |
| WO | 2012097320 | A1 | | 7/2012 | |
| WO | 2012097317 | A3 | | 11/2012 | |
| WO | 2013070250 | A1 | | 5/2013 | |
| WO | 2013096848 | A1 | | 6/2013 | |
| WO | 2014062256 | A2 | | 4/2014 | |
| WO | 2016003817 | A1 | | 1/2016 | |
| WO | 2019094544 | A1 | | 5/2019 | |
| WO | 2019160742 | A2 | | 8/2019 | |
| WO | 2020197868 | A3 | | 11/2020 | |
| WO | 2021040903 | A2 | | 3/2021 | |
| WO | 2022015565 | A1 | | 1/2022 | |

OTHER PUBLICATIONS

International Search Report and Written Opinion in PCT/US2020/023273 dated Oct. 7, 2020; pp. 1-11.

IPRP in PCT2019017085 dated Aug. 27, 2020, pp. 1-8.

AccurateShooter.com Daily Bulletin "New PolyCase Ammunition and Injection-Molded Bullets" Jan. 11, 2015.

International Ammunition Association, Inc. website, published on Apr. 2017, PCP Ammo Variation in U.S. Military Polymer/Metal Cartridge Case R&D, Available on the Internet URL https://forum.cartridgecollectors.org/t/pcp-ammo-variation-in-u-s-military-polyer-metal-cartridge-case-r-d/24400.

International Preliminary Report on Patentability and Written Opinion in PCT/US2018/059748 dated May 12, 2020; pp. 1-8.

International Search Report and Written Opinion for PCTUS201859748 dated Mar. 1, 2019, pp. 1-9.

International Search Report and Written Opinion for PCTUS2019017085 dated Apr. 19, 2019, pp. 1-9.

International Search Report and Written Opinion in PCT/US2019/040323 dated Sep. 24, 2019, pp. 1-16.

International Search Report and Written Opinion in PCT/US2019/040329 dated Sep. 27, 2019, pp. 1-24.

Korean Intellectual Property Office (ISA), International Search Report and Written Opinion for PCT/US2011/062781 dated Nov. 30, 2012, 16 pp.

Korean Intellectual Property Office (ISA), International Search Report and Written Opinion for PCT/US2015/038061 dated Sep. 21, 2015, 28 pages.

Luck Gunner.com, Review: Polymer Cased Rifle Ammunition from PCP Ammo, Published Jan. 6, 2014, Available on the Internet URL https://www.luckygunner.com/lounge/pcp-ammo-review.

YouTube.com—TFB TV, Published on Jul. 23, 2015, available on Internal URL https://www.youtubecom/watch?v=mCjNkbxHkEE.

ISRWO in PCT/US2020/042258 dated Feb. 19, 2021, pp. 1-12.

EESR dated Feb. 4, 2022, pp. 1-7.

EESR dated Jul. 29, 2021, pp. 1-9.

EESR dated Jul. 8, 2021, pp. 1-9.

International Preliminary Report on Patentability and Written Opinion dated Jan. 27, 2022, pp. 1-9.

* cited by examiner

POLYMER AMMUNITION HAVING AN ALIGNMENT AID, CARTRIDGE AND METHOD OF MAKING THE SAME

TECHNICAL FIELD OF THE INVENTION

The present invention relates in general to the field of ammunition, specifically to compositions of matter and methods of making and using polymeric ammunition, polymer cartridges and methods of making the same.

CROSS-REFERENCE TO RELATED APPLICATIONS

This application claims of the benefit of U.S. Provisional Patent Application Ser. No. 62/874,701 filed Jul. 16, 2019 and incorporates same by reference.

STATEMENT OF FEDERALLY FUNDED RESEARCH

None.

INCORPORATION-BY-REFERENCE OF MATERIALS FILED ON COMPACT DISC

None.

BACKGROUND OF THE INVENTION

Without limiting the scope of the invention, its background is described in connection with lightweight polymer cartridge casing ammunition. Conventional ammunition cartridge casings for rifles and machine guns, as well as larger caliber weapons, are made from brass, which is heavy, expensive, and potentially hazardous. There exists a need for an affordable lighter weight replacement for brass ammunition cartridge cases that can increase mission performance and operational capabilities. Lightweight polymer cartridge casing ammunition must meet the reliability and performance standards of existing fielded ammunition and be interchangeable with brass cartridge casing ammunition in existing weaponry. Reliable cartridge casings manufacture requires uniformity (e.g., bullet seating, bullet-to-casing fit, casing strength, etc.) from one cartridge to the next in order to obtain consistent pressures within the casing during firing prior to bullet and casing separation to create uniformed ballistic performance. Plastic cartridge casings have been known for many years but have failed to provide satisfactory ammunition that could be produced in commercial quantities with sufficient safety, ballistic, handling characteristics, and survive physical and natural conditions to which it will be exposed during the ammunition's intended life cycle; however, these characteristics have not been achieved.

For example, U.S. patent application Ser. No. 11/160,682 discloses a base for a cartridge casing body for an ammunition article, the base having an ignition device; an attachment device at one end thereof, the attachment device being adapted to the base to a cartridge casing body; wherein the base is made from plastic, ceramic, or a composite material.

Shortcomings of the known methods of producing plastic or substantially plastic ammunition include the possibility of the projectile being pushed into the cartridge casing, the bullet pull being too light such that the bullet can fall out, the bullet pull being too insufficient to create sufficient chamber pressure, the bullet pull not being uniform from round to round, and portions of the cartridge casing breaking off upon firing causing the weapon to jam or damage or danger when subsequent rounds are fired or when the casing portions themselves become projectiles. To overcome the above shortcomings, improvements in cartridge case design and performance polymer materials are needed.

BRIEF SUMMARY OF THE INVENTION

One embodiment of the present invention provides a polymeric ammunition cartridge. The cartridge includes a substantially cylindrical insert connected to a substantially cylindrical polymeric middle body. The substantially cylindrical insert includes a top surface opposite a bottom surface and a substantially cylindrical coupling element that extends from the bottom surface, a primer recess in the top surface that extends toward the bottom surface, a primer flash hole positioned in the primer recess to extend through the bottom surface, and a flange that extends circumferentially about an outer edge of the top surface. The substantially cylindrical polymeric middle body includes a substantially cylindrical polymeric bullet-end and a substantially cylindrical polymeric coupling end connected by a powder chamber, wherein the substantially cylindrical polymeric coupling end extends over the substantially cylindrical coupling element and covers a circumferential surface of the primer flash hole. Other embodiments include the primer inserted into the primer recess, the charge located in the powder chamber, and/or a bullet or projectile.

BRIEF DESCRIPTION OF THE SEVERAL VIEWS OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
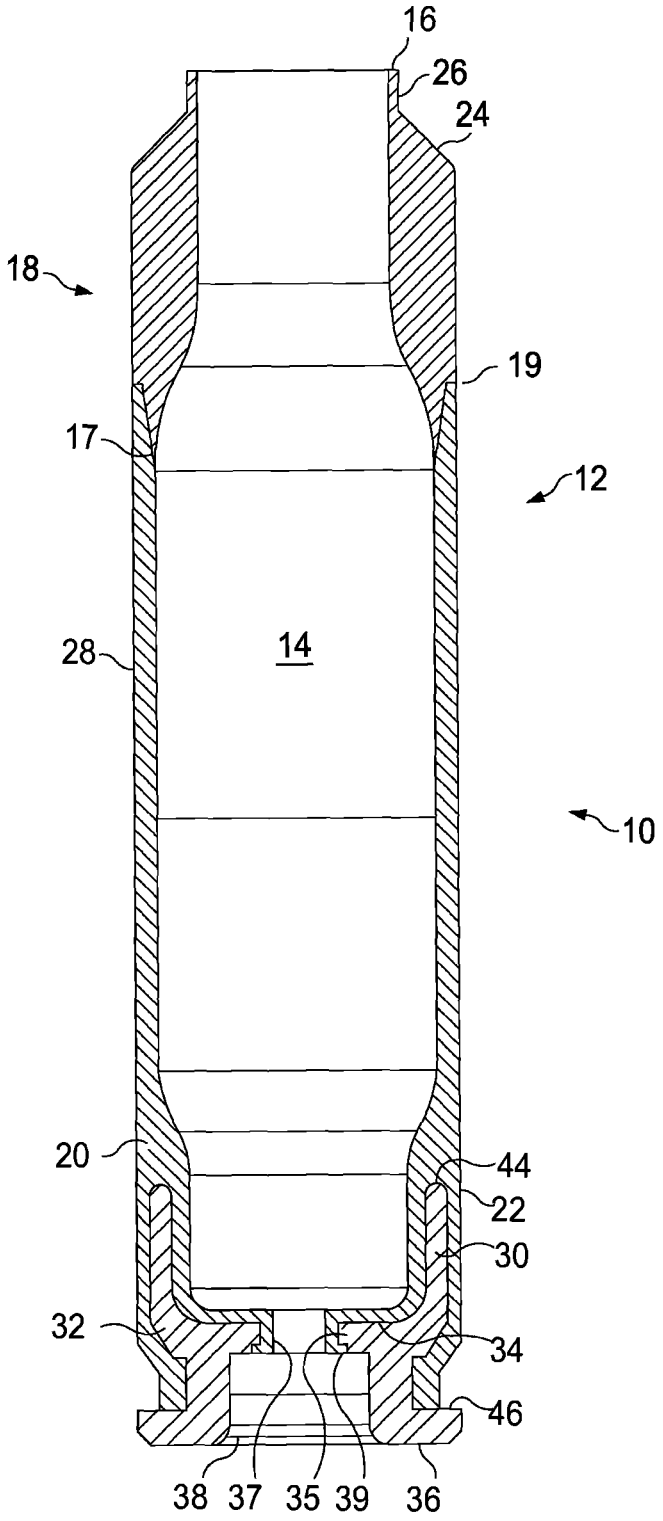
FIG. 1 depicts a side, cross-sectional view of a polymeric cartridge case according to one embodiment of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Reliable cartridge manufacture requires uniformity from one cartridge to the next in order to obtain consistent ballistic performance. Among other considerations, proper bullet seating and bullet-to-casing fit is required. In this manner, a desired pressure develops within the casing during firing prior to bullet and casing separation. Historically, bullets employ a cannelure, which is a slight annular depression formed in a surface of the bullet at a location determined to be the optimal seating depth for the bullet. In this manner, a visual inspection of a cartridge could determine whether or not the bullet is seated at the proper depth. Once the bullet is inserted into the casing to the proper depth, one of two standard procedures is incorporated to lock the bullet in its proper location. One method is the crimping of the entire end of the casing into the cannelure. A second method does not crimp the casing end; rather the bullet is pressure fitted into the casing.

The polymeric ammunition cartridges of the present invention are of a caliber typically carried by soldiers in combat for use in their combat weapons. The present invention is not limited to the described caliber and is believed to be applicable to other calibers as well. This includes various small and medium caliber munitions, including 5.56 mm, 7.62 mm and .50 caliber ammunition cartridges, as well as medium/small caliber ammunition such as 227, 338, 380 caliber, 38 caliber, 9 mm, 10 mm, 20 mm, 25 mm, 30 mm, 40 mm, 45 caliber and the like. The cartridges, therefore, are of a caliber between about .05 and about 5 inches. The polymeric ammunition cartridge wherein the polymeric ammunition cartridge has a caliber selected from .223, .243, .25-06, .270, .300, .308, .338, .30-30, .30-06, .45-70 or .50-90, 50 caliber, 45 caliber, 380 caliber or 38 caliber, 5.56 mm, 6 mm, 7 mm, 7.62 mm, 8 mm, 9 mm, 10 mm, or 12.7 mm. The polymeric ammunition cartridge wherein the polymeric ammunition cartridge has a caliber selected from .308, .338, 50 caliber, 5.56 mm, 7.62 mm, or 12.7 mm. In addition, the present invention is also applicable to the sporting goods industry for use by hunters and target shooters.

The polymeric ammunition cartridge wherein the substantially cylindrical polymeric middle body is formed from a ductile polymer, a nylon polymer or a fiber-reinforced polymeric composite. The polymeric ammunition cartridge wherein the substantially cylindrical polymeric bullet-end upper portion comprises a ductile polymer, a nylon polymer or a fiber-reinforced polymeric composite. The polymeric ammunition cartridge wherein the substantially cylindrical polymeric middle body comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The polymeric ammunition cartridge wherein the substantially cylindrical polymeric bullet-end upper portion comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimide-siloxane) copolymers. The polymeric ammunition cartridge wherein the substantially cylindrical polymeric bullet-end and the substantially cylindrical polymeric bullet-end upper portion are welded or bonded together. The polymeric ammunition cartridge wherein the substantially cylindrical polymeric bullet-end coupling element is welded or bonded to the substantially cylindrical polymeric bullet-end upper portion.

FIG. 1 depicts a side, cross-sectional view of a polymeric cartridge case according to one embodiment of the present invention. A cartridge 10 suitable for use with high velocity rifles is shown manufactured with a polymer casing 12 showing a powder chamber 14 with projectile (not shown) inserted into the forward end opening 16. Polymer casing 12 has a substantially cylindrical open-ended polymeric nose 18 extending from forward end opening 16 rearward to opposite end 17. The nose 18 may be formed with nose junction 19 formed on opposite end 17 to connect to the body component 28. Nose junction 19 is shown as a female element, but may also be configured as a male element in alternate embodiments of the invention. The forward end of nose 18 has a shoulder 24 forming chamber neck 26. The nose 18 typically has a wall thickness between about 0.003 and about 0.200 inches and more preferably between about 0.005 and more preferably between about 0.150 inches about 0.010 and about 0.050 inches.

The middle body component 28 is connected to a substantially cylindrical coupling element 30 of the substantially cylindrical insert 32. Coupling element 30, as shown may be configured as a male element, however, all combinations of male and female configurations is acceptable for coupling elements 30 and coupling end 22 in alternate embodiments of the invention. During over molding the coupling end 22 molds over the coupling element 30 of a substantially cylindrical insert 32. The substantially cylindrical insert 32 includes a substantially cylindrical coupling element 30 extending from a bottom surface 34 that is opposite a top surface 36. Located in the top surface 36 is a primer recess 38 that extends toward the bottom surface 34. A primer flash aperture 35 extends through the bottom surface 34 into the powder chamber 14. The coupling end 22 extends the polymer through the primer flash aperture 35 to form a flash hole 37 while retaining a passage from the top surface 36 through the bottom surface 34 and into the powder chamber 14 to provide support and protection about the primer flash hole 40. A groove 39 is formed in the primer recess 38 around the primer flash aperture 35 and is over molded with the polymer to complete the formation of the flash hole 37. When contacted the coupling end 22 interlocks with the substantially cylindrical coupling element 30, through the coupling element 30 that extends with a taper to a smaller diameter at the tip 44 to form a physical interlock between substantially cylindrical insert 32 and middle body component 28. Polymer casing 12 also has a substantially cylindrical open-ended middle body component 28. The middle body component 28 extends from the nose junction 19 to the coupling element 22. The middle body component 28 typically has a wall thickness between about 0.003 and about 0.200 inches and more preferably between about 0.005 and more preferably between about 0.150 inches about 0.010 and about 0.050 inches.

The nose 16, middle body 18 and bottom surface 34 define the interior of powder chamber 14 in which the powder charge (not shown) is contained. The interior volume of powder chamber 14 may be varied to provide the volume necessary for complete filling of the chamber 14 by the propellant chosen so that a simplified volumetric measure of propellant can be utilized when loading the cartridge. Either a particulate or consolidated propellant can be used.

The substantially cylindrical insert 32 may be a one piece unit formed by MIM, casting forging, machining, etc.; a two piece insert made as individual pieces casting, pressing, stamping, MIM, machining, etc. and combined to form a unitary piece; in other embodiments the substantially cylindrical insert 32 may be a multi-piece insert made as individual pieces casting, pressing, stamping, MIM, machining, etc. and combined to form a unitary piece. The substantially cylindrical insert 32 also has a flange 46 cut therein and a primer recess 38 formed therein for ease of insertion of the primer (not shown). The primer recess 38 is sized so as to receive the primer (not shown) in an interference fit during assembly. A primer flash hole 40 communicates through the bottom surface 34 of substantially cylindrical insert 32 into the powder chamber 14 so that upon detonation of primer (not shown) the powder in powder chamber 14 will be ignited.

Projectile (not shown) is held in place within chamber case neck 26 at forward opening 16 by an interference fit. Mechanical crimping of the forward opening 16 can also be applied to increase the bullet pull force. The bullet (not shown) may be inserted into place following the completion of the filling of powder chamber 14. Projectile (not shown) can also be injection molded directly onto the forward opening 16 prior to welding or bonding together using solvent, adhesive, spin-welding, vibration-welding, ultrasonic-welding or laser-welding techniques. The welding or bonding increases the joint strength so the casing can be extracted from the hot gun casing after firing at the cook-off temperature.

The bullet-end and bullet components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature. An optional first and second annular grooves (cannelures) may be provided in the bullet-end in the interlock surface of the male coupling element to provide a snap-fit between the two components. The cannelures formed in a surface of the bullet at a location determined to be the optimal seating depth for the bullet. Once the bullet is inserted into the casing to the proper depth to lock the bullet in its proper location. One method is the crimping of the entire end of the casing into the cannelures.

The nose and middle body components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature.

Figure 2A:
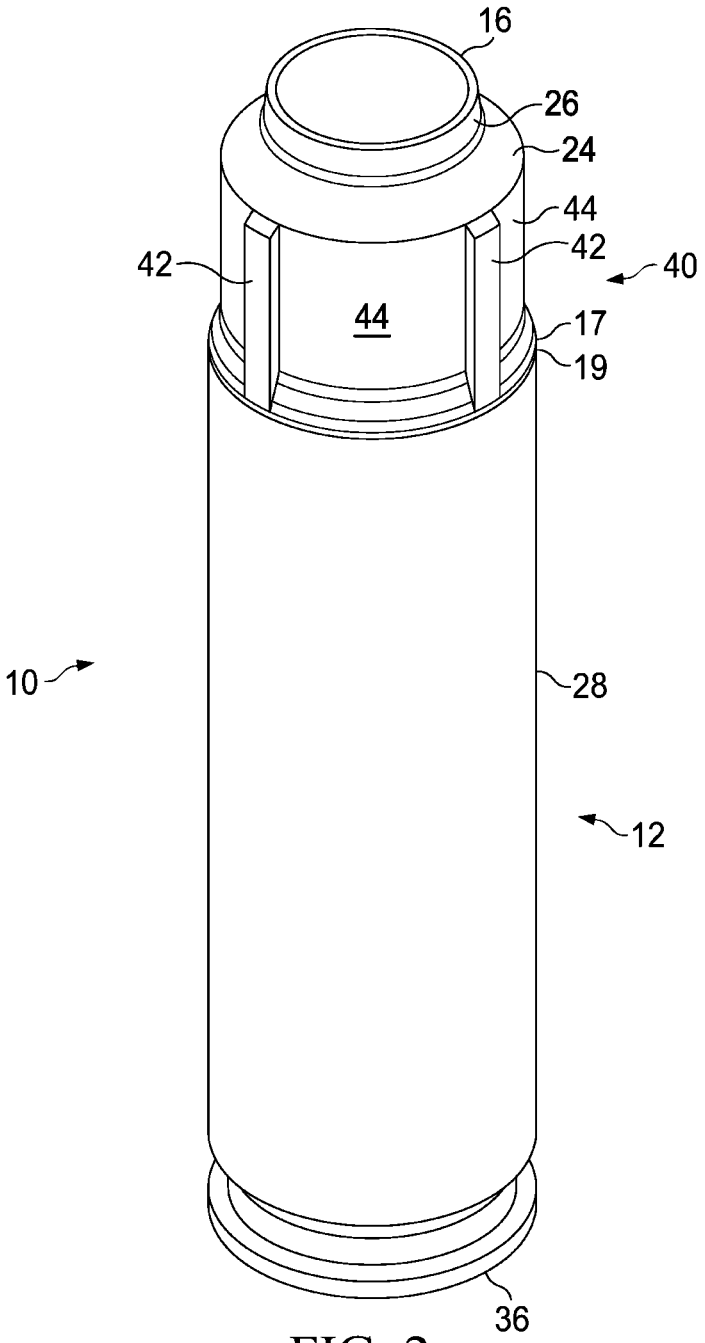
FIGS. 2*a*-2*b* depict perspective views of a polymeric cartridge case according to one embodiment of the present invention.
Figure 2B:
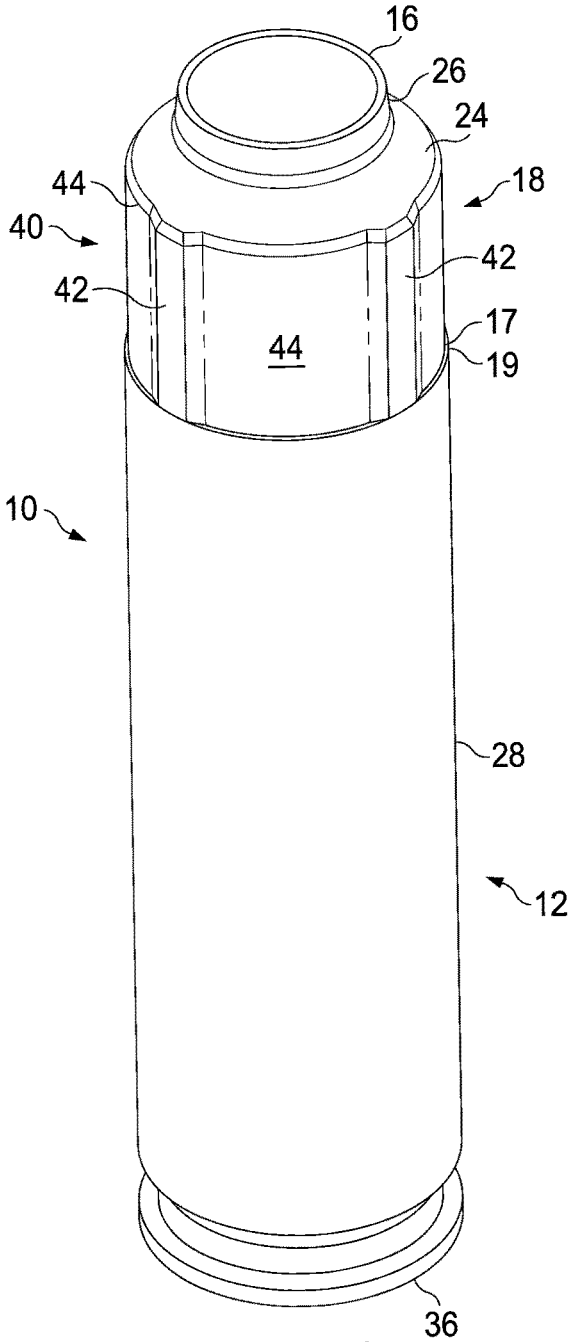

FIGS. 2*a* and 2*b* depict perspective views of a polymeric cartridge case according to one embodiment of the present invention. A cartridge 10 suitable for use with high velocity rifles is shown manufactured with a polymer casing 12 showing a powder chamber (not shown) with projectile (not shown) inserted into the forward end opening 16. Polymer casing 12 has a substantially cylindrical open-ended polymeric nose 18 extending from forward end opening 16 rearward to opposite end 17. The nose 18 may be formed with nose junction 19 formed on opposite end 17 to connect to the body component 28. Nose junction 19 is shown as a female element, but may also be configured as a male element in alternate embodiments of the invention. The forward end of nose 18 has a shoulder 24 forming chamber neck 26. The nose 18 typically has a wall thickness between about 0.003 and about 0.200 inches and more preferably between about 0.005 and more preferably between about 0.150 inches about 0.010 and about 0.050 inches.

The nose 18 includes the alignment aid 40 that aid in the alignment of the nose 18 and in turn the ammunition 10 in the chamber (not shown). The alignment aid 40 includes at least a first tab surface 42 adjacent to a second cut surface 44 in an alternating configuration. In its simplest form the alignment aid 40 may have a curved first tab surface 42 with the second curved cut surface 44 flanking each side of the curved first tab surface 42. This alignment aid 40 is related to a diamond locating pin. A diamond locating pin uses a cut a small amount on four sides, forming a diamond with the original curved section on two opposite sides. This unique shape allows the pin to contact the locating hole with a smaller surface area that prevents movement in one direction (left/right) while allowing a small change in the other direction (up/down). Similarly, the present invention uses the alignment aid 40 having a curved first tab surface 42 with the second curved cut surface 44 flanking each side of the curved first tab surface 42 this unique configuration allows the nose 18 to contact the bore (not shown) of the chamber (not shown) with a smaller surface area that prevents movement in one direction to align the nose 18 in the bore (not shown).

The middle body component 28 is connected to a substantially cylindrical coupling element (not shown) of the substantially cylindrical insert (not shown). Coupling element (not shown), as shown may be configured as a male element, however, all combinations of male and female configurations is acceptable for coupling elements (not shown) and coupling end (not shown) in alternate embodiments of the invention. During over molding the coupling end (not shown) molds over the coupling element (not shown) of a substantially cylindrical insert (not shown). The substantially cylindrical insert (not shown) includes a substantially cylindrical coupling element (not shown) extending from a bottom surface 34 that is opposite a top surface (not shown). Located in the top surface 36 is a primer recess (not shown) that extends toward the bottom surface (not shown). A primer flash aperture (not shown) extends through the bottom surface (not shown) into the powder chamber (not shown). The coupling end (not shown) extends the polymer through the primer flash aperture (not shown) to form a flash hole (not shown) while retaining a passage from the top surface 36 through the bottom surface (not shown) and into the powder chamber (not shown) to provide support and protection about the primer flash hole (not shown). A groove (not shown) is formed in the primer recess (not shown) around the primer flash aperture (not shown) and is over molded with the polymer to complete the formation of the flash hole (not shown). When contacted the coupling end (not shown) interlocks with the substantially cylindrical coupling element (not shown), through the coupling element (not shown) that extends with a taper to a smaller diameter at the tip (not shown) to form a physical interlock between substantially cylindrical insert (not shown) and middle body component 28. Polymer casing 12 also has a substantially cylindrical open-ended middle body component 28. The middle body component 28 extends from the nose junction 19 to the coupling element (not shown).

The nose 16, middle body 18 and bottom surface 34 define the interior of powder chamber 14 in which the powder charge (not shown) is contained. The interior volume of powder chamber 14 may be varied to provide the volume necessary for complete filling of the chamber 14 by the propellant chosen so that a simplified volumetric measure of propellant can be utilized when loading the cartridge. Either a particulate or consolidated propellant can be used.

Projectile (not shown) is held in place within chamber case neck 26 at forward opening 16 by an interference fit. Mechanical crimping of the forward opening 16 can also be applied to increase the bullet pull force. The bullet (not shown) may be inserted into place following the completion of the filling of powder chamber 14. Projectile (not shown) can also be injection molded directly onto the forward opening 16 prior to welding or bonding together using solvent, adhesive, spin-welding, vibration-welding, ultrasonic-welding or laser-welding techniques. The welding or bonding increases the joint strength so the casing can be extracted from the hot gun casing after firing at the cook-off temperature.

The bullet-end and bullet components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature. An optional first and second annular grooves (cannelures) may be provided in the bullet-end in the interlock surface of the male coupling element to provide a snap-fit between the two components. The cannelures formed in a surface of the bullet at a location determined to be the optimal seating depth for the bullet. Once the bullet is inserted into the casing to the proper depth to lock the bullet in its proper location. One method is the crimping of the entire end of the casing into the cannelures.

The nose and middle body components can then be welded or bonded together using solvent, adhesive, spin-welding, vibration-welding, ultrasonic-welding or laser-welding techniques. The welding or bonding increases the joint strength so the casing can be extracted from the hot gun casing after firing at the cook-off temperature.

Figure 3:
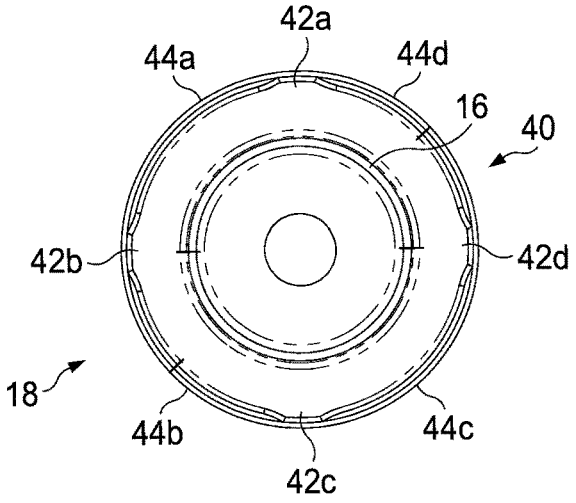
FIG. 3 depicts a top down view of the nose of the polymeric cartridge case according to one embodiment of the present invention.

FIG. 3 depicts a top down view of the nose of the polymeric cartridge case according to one embodiment of the present invention. The nose 18 includes the alignment aid 40 that aid in the alignment of the nose 18 and in turn the ammunition (not shown) in the chamber (not shown). The alignment aid 40 includes first tab surfaces 42*a*, 42*b*, 42*c*, and 42*d* adjacent to second cut surfaces 44*a*, 44*b*, 44*c*, and 44*d* in an alternating configuration. The alignment aid 40 includes first tab surfaces 42*a* which is adjacent to second cut surfaces 44*a* which is adjacent to first tab surfaces 42*b* which is adjacent to second cut surfaces 44*b* which is adjacent to first tab surfaces 42*c* which is adjacent to second cut surfaces 44*c* which is adjacent to first tab surfaces 42*d* which is adjacent to second cut surfaces 44*d* which is adjacent to first tab surface 42*a*. This unique configuration allows the nose 18 to contact the bore (not shown) of the chamber (not shown) with a smaller surface area that prevents movement in one direction to align the nose 18 in the bore (not shown).

Figure 4C:
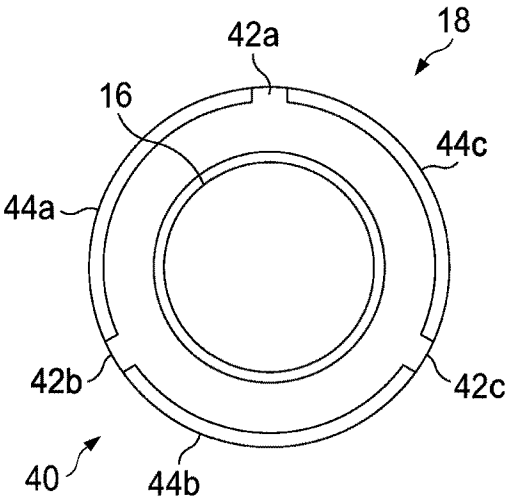
FIGS. 4*a*-4*i* depict a top down views of the nose of the polymeric cartridge case according to different embodiment of the present invention.
Figure 4B:
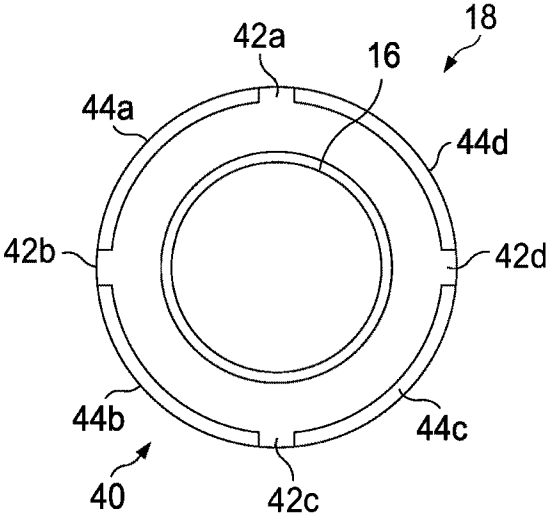
Figure 4A:
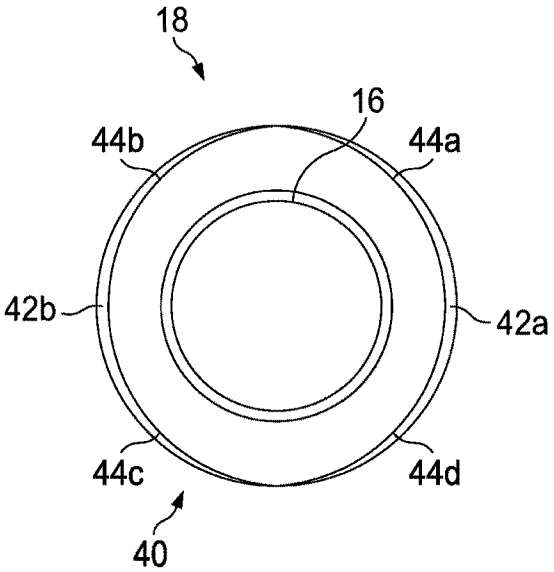

FIG. 4*a* depicts a top down view of the nose of the polymeric cartridge case according to one embodiment of the present invention. The nose 18 includes the forward opening 16 and the alignment aid 40 that aid in the alignment of the nose 18 and in turn the ammunition (not shown) in the chamber (not shown). The alignment aid 40 includes first tab surfaces 42*a* and 42*b* adjacent to second cut surfaces 44*a*, 44*b*, 44*c*, and 44*d* in an alternating configuration. The alignment aid 40 includes first tab surface 42*a* which is adjacent to second cut surfaces 44*a* which is adjacent to second cut surfaces 44*b* which is adjacent to first tab surface 42*b* which is adjacent to second cut surfaces 44*c* which is adjacent to second cut surfaces 44*d* which is adjacent to first tab surface 42*a*. This unique configuration allows the nose 18 to contact the bore (not shown) of the chamber (not shown) with a smaller surface area that prevents movement in one direction to align the nose 18 in the bore (not shown).

FIG. 4*b* depicts a top down view of the nose of the polymeric cartridge case according to one embodiment of the present invention. The nose 18 includes the forward opening 16 and the alignment aid 40 that aid in the alignment of the nose 18 and in turn the ammunition (not shown) in the chamber (not shown). The alignment aid 40 includes first tab surfaces 42*a*, 42*b*, 42*c*, and 42*d* adjacent to second cut surfaces 44*a*, 44*b*, 44*c*, and 44*d* in an alternating configuration. The alignment aid 40 includes first tab surface 42*a* which is adjacent to second cut surfaces 44*a* which is adjacent to first tab surface 42*b* which is adjacent to second cut surfaces 44*b* which is adjacent to first tab surface 42*c* which is adjacent to second cut surfaces 44*c* which is adjacent to first tab surface 42*d* which is adjacent to second cut surfaces 44*d* which is adjacent to first tab surface 42*a*. This unique configuration allows the nose 18 to contact the bore (not shown) of the chamber (not shown) with a smaller surface area that prevents movement in one direction to align the nose 18 in the bore (not shown).

FIG. 4*c* depicts a top down view of the nose of the polymeric cartridge case according to one embodiment of the present invention. The nose 18 includes the forward opening 16 and the alignment aid 40 that aid in the alignment of the nose 18 and in turn the ammunition (not shown) in the chamber (not shown). The alignment aid 40 includes first tab surfaces 42*a*, 42*b*, and 42*c* adjacent to second cut surfaces 44*a*, 44*b*, and 44*c* in an alternating configuration. The alignment aid 40 includes first tab surface 42*a* which is adjacent to second cut surfaces 44*a* which is adjacent to first tab surface 42*b* which is adjacent to second cut surfaces 44*b* which is adjacent to first tab surface 42*c* which is adjacent to second cut surfaces 44*c* which is adjacent to first tab surface 42*a*. This unique configuration allows the nose 18 to contact the bore (not shown) of the chamber (not shown) with a smaller surface area that prevents movement in one direction to align the nose 18 in the bore (not shown).

Figure 4F:
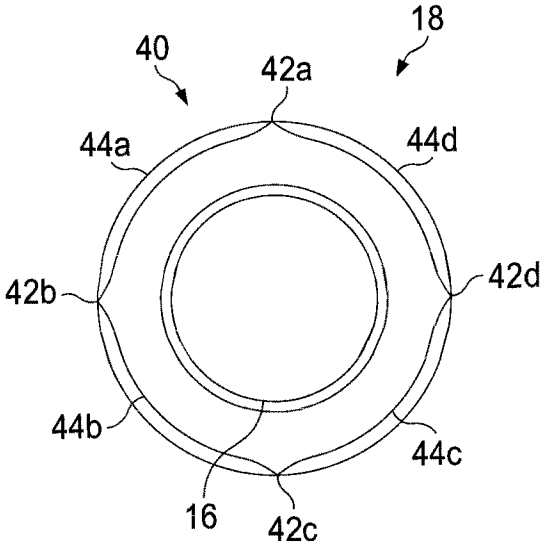
Figure 4E:
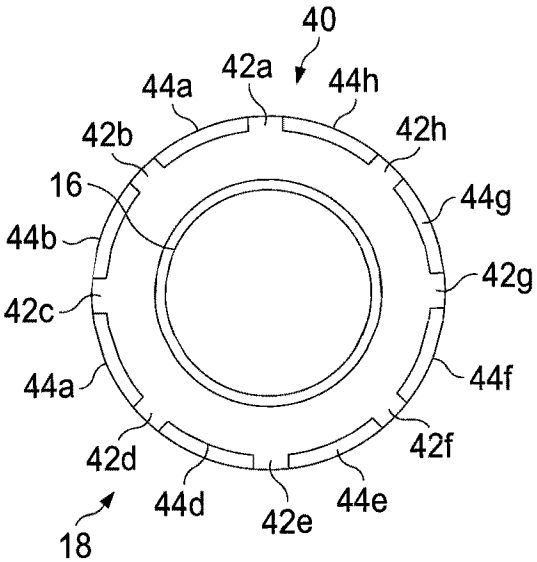
Figure 4D:
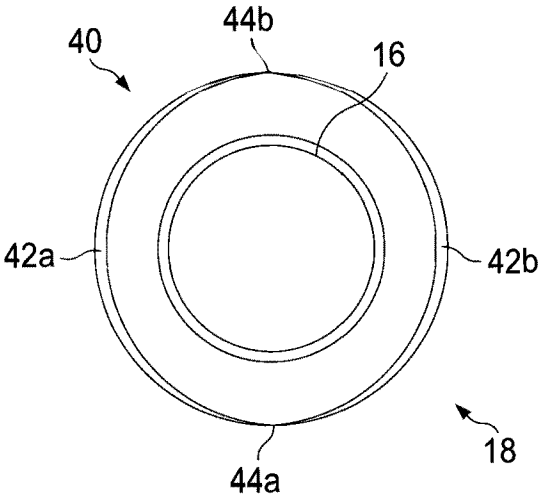

FIG. 4*d* depicts a top down view of the nose of the polymeric cartridge case according to one embodiment of the present invention. The nose 18 includes the forward opening 16 and the alignment aid 40 that aid in the alignment of the nose 18 and in turn the ammunition (not shown) in the chamber (not shown). The alignment aid 40 includes first tab surfaces 42*a* and 42*b* adjacent to second cut surfaces 44*a* and 44*b* in an alternating configuration. The alignment aid 40 includes first tab surface 42*a* which is adjacent to second cut surfaces 44*a* which is adjacent to first tab surface 42*b* which is adjacent to second cut surfaces 44*b* which is adjacent to first tab surface 42*a*. This unique configuration allows the nose 18 to contact the bore (not shown) of the chamber (not shown) with a smaller surface area that prevents movement in one direction to align the nose 18 in the bore (not shown).

FIG. 4*e* depicts a top down view of the nose of the polymeric cartridge case according to one embodiment of the present invention. The nose 18 includes the forward opening 16 and the alignment aid 40 that aid in the alignment of the nose 18 and in turn the ammunition (not shown) in the chamber (not shown). The alignment aid 40 includes first tab surfaces 42*a*, 42*b*, 42*c*, 42*d*, 42*e* and 42*f* adjacent to second cut surfaces 44*a*, 44*b*, 44*c*, 44*d*, 44*e* and 44*f* in an alternating configuration. The alignment aid 40 includes first tab surface 42*a* which is adjacent to second cut surfaces 44*a* which is adjacent to first tab surface 42*b* which is adjacent to second cut surfaces 44*b* which is adjacent to first tab surface 42*c* which is adjacent to second cut surfaces 44*c* which is adjacent to first tab surface 42*d* which is adjacent to second cut surfaces 44*d* which is adjacent to first tab surface 42*e* which is adjacent to second cut surfaces 44*e* which is adjacent to first tab surface 42*f* which is adjacent to second cut surfaces 44*f* which is adjacent to first tab surface 42*g* which is adjacent to second cut surfaces 44*g* which is adjacent to first tab surface 42*h* which is adjacent to second cut surfaces 44*h* which is adjacent to first tab surface 42*a*.

FIG. 4*f* depicts a top down view of the nose of the polymeric cartridge case according to one embodiment of the present invention. The nose 18 includes the forward opening 16 and the alignment aid 40 that aid in the alignment of the nose 18 and in turn the ammunition (not shown) in the chamber (not shown). The alignment aid 40 includes first tab surfaces 42*a*, 42*b*, 42*c*, and 42*d* (shown as angles) adjacent to second cut surfaces 44*a*, 44*b*, 44*c*, and 44*d* in an alternating configuration. The alignment aid 40 includes first tab surface 42*a* which is adjacent to second cut surfaces 44*a* which is adjacent to first tab surface 42*b* which is adjacent to second cut surfaces 44*b* which is adjacent to first tab surface 42*c* which is adjacent to second cut surfaces 44*c* which is adjacent to first tab surface 42*d* which is adjacent to second cut surfaces 44*d* which is adjacent to first tab surface 42*a*. This unique configuration allows the nose 18 to contact the bore (not shown) of the chamber (not shown) with a smaller surface area that prevents movement in one direction to align the nose 18 in the bore (not shown).

Figure 4I:
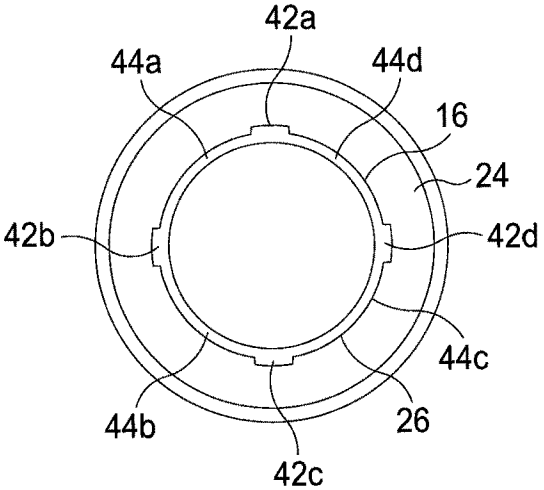
Figure 4H:
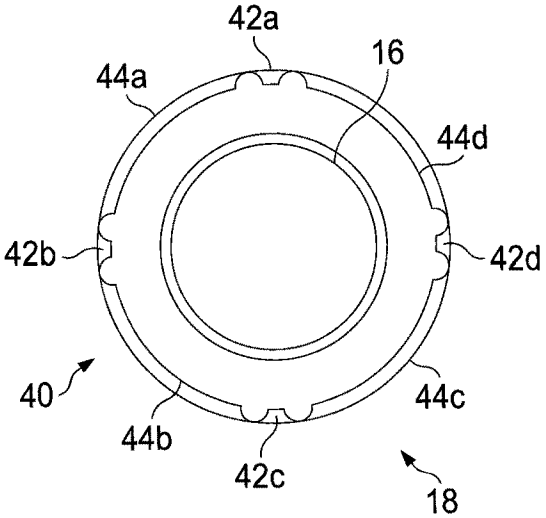
Figure 4G:
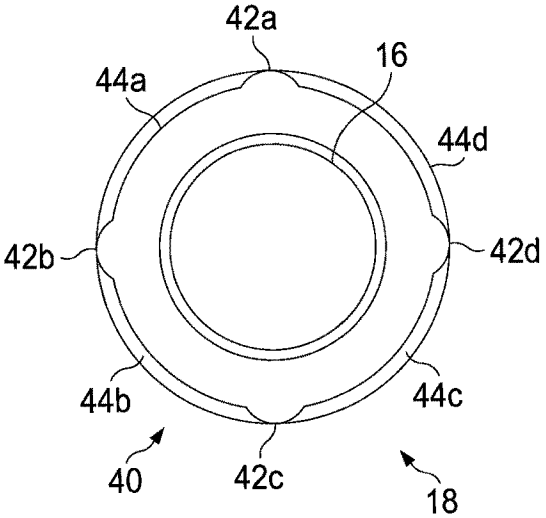

FIG. 4*g* depicts a top down view of the nose of the polymeric cartridge case according to one embodiment of the present invention. The nose 18 includes the forward opening 16 and the alignment aid 40 that aid in the alignment of the nose 18 and in turn the ammunition (not shown) in the chamber (not shown). The alignment aid 40 includes first tab surfaces 42*a*, 42*b*, 42*c*, and 42*d* (shown as half circles) adjacent to second cut surfaces 44*a*, 44*b*, 44*c*, and 44*d* in an alternating configuration. The alignment aid 40 includes first tab surface 42*a* which is adjacent to second cut surfaces 44*a* which is adjacent to first tab surface 42*b* which is adjacent to second cut surfaces 44*b* which is adjacent to first tab surface 42*c* which is adjacent to second cut surfaces 44*c* which is adjacent to first tab surface 42*d* which is adjacent to second cut surfaces 44*d* which is adjacent to first tab surface 42*a*. This unique configuration allows the nose 18 to contact the bore (not shown) of the chamber (not shown) with a smaller surface area that prevents movement in one direction to align the nose 18 in the bore (not shown).

FIG. 4*h* depicts a top down view of the nose of the polymeric cartridge case according to one embodiment of the present invention. The nose 18 includes the forward opening 16 and the alignment aid 40 that aid in the alignment of the nose 18 and in turn the ammunition (not shown) in the chamber (not shown). The alignment aid 40 includes first tab surfaces 42*a*, 42*b*, 42*c*, and 42*d* (shown as 2 adjacent half circles) adjacent to second cut surfaces 44*a*, 44*b*, 44*c*, and 44*d* in an alternating configuration. The alignment aid 40 includes first tab surface 42*a* which is adjacent to second cut surfaces 44*a* which is adjacent to first tab surface 42*b* which is adjacent to second cut surfaces 44*b* which is adjacent to first tab surface 42*c* which is adjacent to second cut surfaces 44*c* which is adjacent to first tab surface 42*d* which is adjacent to second cut surfaces 44*d* which is adjacent to first tab surface 42*a*. This unique configuration allows the nose 18 to contact the bore (not shown) of the chamber (not shown) with a smaller surface area that prevents movement in one direction to align the nose 18 in the bore (not shown).

FIG. 4*i* depicts a top down view of the nose of the polymeric cartridge case according to one embodiment of the present invention. The nose 18 includes the forward opening 16, shoulder 24 forming chamber neck 26. and the alignment aid 40 that aid in the alignment of the nose 18 and in turn the ammunition (not shown) in the chamber (not shown). The alignment aid 40 is positioned on the neck 26 and includes first tab surfaces 42*a*, 42*b*, 42*c*, and 42*d* adjacent to second cut surfaces 44*a*, 44*b*, 44*c*, and 44*d* in an alternating configuration. The alignment aid 40 includes first tab surface 42*a* which is adjacent to second cut surfaces 44*a* which is adjacent to first tab surface 42*b* which is adjacent to second cut surfaces 44*b* which is adjacent to first tab surface 42*c* which is adjacent to second cut surfaces 44*c* which is adjacent to first tab surface 42*d* which is adjacent to second cut surfaces 44*d* which is adjacent to first tab surface 42*a*. This unique configuration allows the nose 18 to contact the bore (not shown) of the chamber (not shown) with a smaller surface area that prevents movement in one direction to align the nose 18 in the bore (not shown). Although the first tab surface is shown as squares it may be any shape e.g., first tab surface shown in FIGS. 4*a*-4*i*.

This unique configuration allows the nose 18 to contact the bore (not shown) of the chamber (not shown) with a smaller surface area that prevents movement in one direction to align the nose 18 in the bore (not shown).

It is understood that the FIGS. 4*a*-4*i* are meant for illustration and are not bound to any lengths. As such, the length of the first tabs surface and the second cut surfaces may be of any length necessary provided they form a aperture. In addition, the first tabs surface and the second cut surfaces may be uniformed in length and curvature or may be asymmetric depending on the specific application.

Polymer casing 12 also has a substantially cylindrical open-ended middle body component 28. Located in the top surface 36 is a primer recess 38 that extends toward the bottom surface 34 with a diffuser 50 positioned in the primer recess 38. The diffuser 50 includes a diffuser aperture 52 and a diffuser aperture extension 54 that aligns with the primer flash hole 40. The diffuser 50 is a device that is used to divert the affects of the primer (not shown) off of the polymer. The affects being the impact from igniting the primer as far as pressure and heat to divert the energy of the primer off of the polymer and directing it to the flash hole. The diffuser 50 can be between 0.004 to 0.010 inches in thickness and made from half hard brass. For example, the diffuser 50 can be between 0.005 inches thick for a 5.56 diffuser 50. The OD of the diffuser for a 5.56 or 223 case is 0.173 and the ID is 0.080. The Diffuser could be made of any material that can withstand the energy from the ignition of the primer. This would include steel, stainless, cooper, aluminum or even an engineered resin that was injection molded or stamped.

The polymeric and composite casing components may be injection molded. Polymeric materials for the bullet-end and middle body components must have propellant compatibility and resistance to gun cleaning solvents and grease, as well as resistance to chemical, biological and radiological agents. The polymeric materials must have a temperature resistance higher than the cook-off temperature of the propellant, typically about 320° F. The polymeric materials must have elongation-to-break values that to resist deformation under interior ballistic pressure as high as 60,000 psi in all environments (temperatures from about −65 to about 320° F. and humidity from 0 to 100% RH). According to one embodiment, the middle body component is either molded onto or snap-fit to the casing head-end component after which the bullet-end component is snap-fit or interference fit to the middle body component. The components may be formed from high-strength polymer, composite or ceramic.

Examples of suitable high strength polymers include composite polymer material including a tungsten metal powder, nylon 6/6, nylon 6, and glass fibers; and a specific gravity in a range of 3-10. The tungsten metal powder may be 50%-96% of a weight of the bullet body. The polymer material also includes about 0.5-15%, preferably about 1-12%, and most preferably about 2-9% by weight, of nylon 6/6, about 0.5-15%, preferably about 1-12%, and most preferably about 2-9% by weight, of nylon 6, and about 0.5-15%, preferably about 1-12%, and most preferably about 2-9% by weight, of glass fibers. It is most suitable that each of these ingredients be included in amounts less than 10% by weight. The cartridge casing body may be made of a modified ZYTEL resin, available from E.I. DuPont De Nemours Co., a modified 612 nylon resin, modified to increase elastic response.

Examples of suitable polymers include polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyaryl-sulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, or urethane hybrids. Examples of suitable polymers also include aliphatic or aromatic polyamide, polyeitherimide, polysulfone, polyphenylsulfone, poly-phenylene oxide, liquid crystalline polymer and polyketone. Examples of suitable composites include polymers such as polyphenylsulfone reinforced with between about 30 and about 70 wt %, and preferably up to about 65 wt % of one or more reinforcing materials selected from glass fiber, ceramic fiber, carbon fiber, mineral fillers, organo nanoclay, or carbon nanotube. Preferred reinforcing materials, such as chopped surface-treated E-glass fibers provide flow characteristics at the above-described loadings comparable to unfilled polymers to provide a desirable combination of strength and flow characteristics that permit the molding of head-end components. Composite components can be formed by machining or injection molding. Finally, the cartridge case must retain sufficient joint strength at cook-off temperatures. More specifically, polymers suitable for molding of the projectile-end component have one or more of the following properties: Yield or tensile strength at −65° F.>10,000 psi Elongation-to-break at −65° F.>15% Yield or tensile strength at 73° F.>8,000 psi Elongation-to-break at 73° F.>50% Yield or tensile strength at 320° F.>4,000 psi Elongation-to-break at 320° F.>80%. Polymers suitable for molding of the middle-body component have one or more of the following properties: Yield or tensile strength at −65° F.>10,000 psi Yield or tensile strength at 73° F.>8,000 psi Yield or tensile strength at 320° F.>4,000 psi.

Commercially available polymers suitable for use in the present invention thus include polyphenylsulfones; copolymers of polyphenylsulfones with polyether-sulfones or polysulfones; copolymers and blends of polyphenylsulfones with polysiloxanes; poly(etherimide-siloxane); copolymers and blends of polyetherimides and polysiloxanes, and blends of polyetherimides and poly(etherimide-siloxane) copolymers; and the like. Particularly preferred are polyphenylsulfones and their copolymers with poly-sulfones or polysiloxane that have high tensile strength and elongation-to-break to sustain the deformation under high interior ballistic pressure. Such polymers are commercially available, for example, RADEL R5800 polyphenylesulfone from Solvay Advanced Polymers. The polymer can be formulated with up to about 10 wt % of one or more additives selected from internal mold release agents, heat stabilizers, anti-static agents, colorants, impact modifiers and UV stabilizers.

The polymers of the present invention can also be used for conventional two-piece metal-plastic hybrid cartridge case designs and conventional shotgun shell designs. One example of such a design is an ammunition cartridge with a one-piece substantially cylindrical polymeric cartridge casing body with an open projectile-end and an end opposing the projectile-end with a male or female coupling element; and a cylindrical metal cartridge casing head-end component with an essentially closed base end with a primer hole opposite an open end having a coupling element that is a mate for the coupling element on the opposing end of the polymeric cartridge casing body joining the open end of the head-end component to the opposing end of the polymeric cartridge casing body. The high polymer ductility permits the casing to resist breakage.

One embodiment includes a 2 cavity prototype mold having an upper portion and a base portion for a 5.56 case having a metal insert over-molded with a Nylon 6 (polymer) based material. In this embodiment the polymer in the base includes a lip or flange to extract the case from the weapon.

One 2-cavity prototype mold to produce the upper portion of the 5.56 case can be made using a stripper plate tool using an Osco hot spur and two subgates per cavity. Another embodiment includes a subsonic version, the difference from the standard and the subsonic version is the walls are thicker thus requiring less powder. This will decrease the velocity of the bullet thus creating a subsonic round.

The extracting inserts is used to give the polymer case a tough enough ridge and groove for the weapons extractor to grab and pull the case out the chamber of the gun. The extracting insert is made of 17-4 ss that is hardened to 42-45 rc. The insert may be made of aluminum, brass, cooper, steel or even an engineered resin with enough tensile strength.

The insert is over molded in an injection molded process using a nano clay particle filled Nylon material. The inserts can be machined or stamped. In addition, an engineered resin able to withstand the demand on the insert allows injection molded and/or even transfer molded.

One of ordinary skill in the art will know that many propellant types and weights can be used to prepare workable ammunition and that such loads may be determined by a careful trial including initial low quantity loading of a given propellant and the well known stepwise increasing of a given propellant loading until a maximum acceptable load is achieved. Extreme care and caution is advised in evaluating new loads. The propellants available have various burn rates and must be carefully chosen so that a safe load is devised.

The description of the preferred embodiments should be taken as illustrating, rather than as limiting, the present invention as defined by the claims. As will be readily appreciated, numerous combinations of the features set forth above can be utilized without departing from the present invention as set forth in the claims. Such variations are not regarded as a departure from the spirit and scope of the invention, and all such modifications are intended to be included within the scope of the following claims.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB.

Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A polymeric ammunition cartridge comprising:

a substantially cylindrical insert comprising a top surface opposite a bottom surface and a substantially cylindrical coupling element that extends from the bottom surface, a primer recess in the top surface that extends toward the bottom surface, a primer flash hole positioned in the primer recess to extend through the bottom surface, and a flange that extends circumferentially about an outer edge of the top surface; and a substantially cylindrical polymeric middle body comprising a substantially cylindrical polymeric coupling end connected by a powder chamber, wherein the substantially cylindrical polymeric coupling end extends over the substantially cylindrical coupling element and covers a circumferential surface of the primer flash hole; and a substantially cylindrical polymeric nose comprising a projectile aperture formed in a neck, a shoulder extending from the neck and nose junction adapted to connect to the substantially cylindrical polymeric middle body and an alignment aid configured to prevent rotational movement of the ammunition cartridge in a chamber of a firearm, the alignment aid comprising a plurality of radially extending tabs formed on an outer surface of the nose and below the shoulder, a top surface of each of the radially extending tabs slanting angularly from a proximal end of the shoulder to an outer tab surface defining an outer diameter substantially equal to an outer diameter of the substantially cylindrical polymeric middle body, wherein each of the radially extending tabs is separated from an adjacent one of the radially extending tabs by a recessed surface.

2. The polymeric ammunition cartridge of claim 1, wherein the substantially cylindrical polymeric middle body is formed from a ductile polymer.

3. The polymeric ammunition cartridge of claim 1, wherein the substantially cylindrical polymeric middle body comprise a nylon polymer.

4. The polymeric ammunition cartridge of claim 1, wherein the substantially cylindrical polymeric middle body is formed from a fiber-reinforced polymeric composite.

5. The polymeric ammunition cartridge of claim 4, wherein the fiber-reinforced polymeric composite contains between about 10 and about 70 wt % glass fiber fillers, mineral fillers, or mixtures thereof.

6. The polymeric ammunition cartridge of claim 1, wherein the substantially cylindrical polymeric bullet-end and bullet are further welded or bonded together.

7. The polymeric ammunition cartridge of claim 1, wherein a bullet is adhesively fitted to the forward opening end.

8. The polymeric ammunition cartridge of claim 1, further comprising a groove positioned around the primer flash aperture in the primer recess.

9. The polymeric ammunition cartridge of claim 1, wherein the alignment aid comprises one or more first tabs surface each separated by a second cut surface.

10. The polymeric ammunition cartridge of claim 1, wherein the alignment aid comprises at least four first tabs surface each separated by a second cut surface.

11. The polymeric ammunition cartridge of claim 1, wherein the substantially cylindrical polymeric middle body comprise a polymers selected from the group consisting of polyurethane prepolymer, cellulose, fluoro-polymer, ethylene inter-polymer alloy elastomer, ethylene vinyl acetate, nylon, polyether imide, polyester elastomer, polyester sulfone, polyphenyl amide, polypropylene, polyvinylidene fluoride or thermoset polyurea elastomer, acrylics, homopolymers, acetates, copolymers, acrylonitrile-butadinen-styrene, thermoplastic fluoro polymers, inomers, polyamides, polyamide-imides, polyacrylates, polyatherketones, polyarylsulfones, polybenzimidazoles, polycarbonates, polybutylene, terephthalates, polyether imides, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, polycarbonates, allyls, aminos, cyanates, epoxies, phenolics, unsaturated polyesters, bismaleimides, polyurethanes, silicones, vinylesters, urethane hybrids, polyphenylsulfones, copolymers of polyphenylsulfones with polyethersulfones or polysulfones, copolymers of poly-phenylsulfones with siloxanes, blends of polyphenylsulfones with polysiloxanes, poly(etherimide-siloxane) copolymers, blends of polyetherimides and polysiloxanes, and blends of polyetherimides and poly(etherimidesiloxane) copolymers.

12. The polymeric ammunition cartridge of claim 1, wherein the forward opening end comprises a neck with a plurality of internal structures for supporting a bullet.

13. The polymeric ammunition cartridge of claim 1, wherein the substantially cylindrical coupling element is a male coupling element with a straight skirt interlock surface that tapers to a smaller diameter at the forward portion on the skirt tip to mate with a female coupling element of the substantially cylindrical polymeric coupling end.

14. The polymeric ammunition cartridge of claim 1, further comprising a diffuser positioned in the primer recess comprising a diffuser flash hole aligned with the primer flash hole.

15. A chamber adapted to accept the ammunition cartridge of claim 1.

16. The polymeric ammunition cartridge of claim 1, wherein the slanted angular top surface of the radially extending tabs extends fully about the circumference of a junction of the proximal end of the shoulder and the alignment aid to define a slanted angular lip.

* * * * *